US007320453B2

(12) United States Patent
Berlyn et al.

(10) Patent No.: US 7,320,453 B2
(45) Date of Patent: Jan. 22, 2008

(54) SUSPENSION SYSTEM FOR HVAC EQUIPMENT

(75) Inventors: Daniel E Berlyn, Phoenix, AZ (US); Ward D. Cole, Glendale, AZ (US); Bradley Kevin Hall, Peoria, AZ (US); Steven Joseph Wilkie, Phoenix, AZ (US); Frank Edward Cole, Surprise, AZ (US)

(73) Assignee: Mad Metals, Inc., Phoenix, AZ (US)

( * ) Notice: Subject to any disclaimer, the term of this patent is extended or adjusted under 35 U.S.C. 154(b) by 171 days.

(21) Appl. No.: 11/065,526

(22) Filed: Feb. 24, 2005

(65) Prior Publication Data

US 2005/0189462 A1 Sep. 1, 2005

Related U.S. Application Data

(60) Provisional application No. 60/548,491, filed on Feb. 27, 2004.

(51) Int. Cl.
*A47H 1/00* (2006.01)

(52) U.S. Cl. ..... 248/328; 248/317; 248/320; 248/322

(58) Field of Classification Search ..... 248/317, 248/320, 322, 323, 327, 328; 62/297, 521, 62/139, 140
See application file for complete search history.

(56) References Cited

U.S. PATENT DOCUMENTS 77,787 A * 5/1868 Colborn ..... 217/60 R
382,171 A * 5/1888 Lutz ..... 248/62
528,319 A * 10/1894 Beaton ..... 248/60
670,870 A * 3/1901 Dorzeski ..... 248/58
2,025,377 A * 12/1935 Crannell ..... 292/264
2,057,092 A * 10/1936 Geib ..... 182/113
3,285,393 A * 11/1966 Johnson ..... 198/827
3,355,030 A * 11/1967 Cathcart ..... 211/88.04
3,424,415 A * 1/1969 Nadherny ..... 248/53
3,907,118 A * 9/1975 Pelavin ..... 211/113
4,061,092 A * 12/1977 Jacobsen et al. ..... 108/149
4,749,075 A * 6/1988 Foster ..... 414/525.1
5,794,894 A * 8/1998 Fremund ..... 248/53
6,457,692 B1 * 10/2002 Gohl, Jr. ..... 248/317

FOREIGN PATENT DOCUMENTS

GB 2092257 * 8/1982

* cited by examiner

*Primary Examiner*—Amy J. Sterling
(74) *Attorney, Agent, or Firm*—Venable, Campillo, Logan & Meaney, P.C.

(57) ABSTRACT

Generally, the present invention (referred to also as the "suspension system") is incorporated in a system for suspending an HVAC unit from one or more wood truss members through the use of one or more top lock plates connected to the wood truss, one or more bottom lock plates connected to the HVAC unit, and one or more suspension chains connected between the top lock plates and the bottom lock plates. The suspension system provides a system for suspending HVAC equipment in residential and light commercial applications that is safer, quicker, cheaper, more reliable and more accurate than systems currently in use.

2 Claims, 6 Drawing Sheets

SUSPENSION SYSTEM FOR HVAC EQUIPMENT

CROSS-REFERENCE TO RELATED APPLICATIONS

The present application claims the benefit of U.S. Provisional Application No. 60/548,491 filed Feb. 27, 2004, which is entirely incorporated herein by reference.

BACKGROUND OF THE INVENTION

1. Field of the Invention

The present invention relates generally to installation of residential and light commercial HVAC equipment, and more particularly to suspension systems for air handlers, gas furnaces, and related HVAC equipment in attics and crawlspaces.

2. Discussion of the Related Art

Currently, residential and light commercial HVAC equipment, including air handlers and gas furnaces, are typically installed in attics and crawlspaces in the manner illustrated in FIG. 1 (referred to herein as the "prior art manner of installation"). FIG. 1 shows 22-gauge sheet metal strapping 10, nailed to overhead wood trusses at the top and connected to a secondary pan 12 at the bottom. Near the bottom, a length of angle iron 14 is connected to the 22-gauge sheet metal strapping 10 to form a cradle upon which sits the HVAC unit 5. Several shortcomings are inherent with the prior art manner of installation.

For example, the prior art manner of installation typically requires at least two people to carry out the installation. The prior art manner of installation requires the usage of heavy and relatively expensive angle iron 14. The prior art manner of installation lacks adjustability, which makes it difficult to achieve the proper pitch (or levelness) of the HVAC unit 5. The prior art manner of installation also makes it difficult to achieve the proper pitch for the secondary pan 12. The prior art manner installation requires the 22-gauge strapping 10 to be cut to fit in the field, which leaves the 22-gauge strapping 10 with sharp corners and edges that can injure the installers, other trades people, the owner or anyone else in the area. The prior art manner of installation leaves the secondary pan 12 in a position that often gets bumped by other tradesmen and/or the owner, which can bend the secondary pan 12 and defeat the purpose of the secondary pan 12 by permitting leakage onto surfaces below. Similarly, the prior art manner of installation can permit leakage from the air handler 5 to travel along the length of the angle iron 14, bypassing the secondary pan 12, and drip on surfaces below.

Other hanging apparatus have been disclosed in the following United States or foreign patents: U.S. Pat. No. 77,587 (L H Colbom), U.S. Pat. No. 382,171 (G W Lutz), U.S. Pat. No. 528,319 (A J Beaton), U.S. Pat. No. 670,870 (J R Drozeski), U.S. Pat. No. 2,025,377 (C W Crannel), U.S. Pat. No. 2,057,092 (R L Geib), U.S. Pat. No. 3,355,030 (N E Cathcart), U.S. Pat. No. 3,907,118 (J Y Pelavin), U.S. Pat. No. GB 2,092,257 (J Harding), and U.S. Pat. No. 6,457,692 (W E Gohl, Jr.). None of these references, however, disclose the aspects of the current invention.

SUMMARY OF THE INVENTION

The invention is summarized below only for purposes of introducing embodiments of the invention. The ultimate scope of the invention is to be limited only to the claims that follow the specification.

Generally, the present invention (referred to also as the "suspension system") is incorporated in a system for suspending an HVAC unit 5 from one or more top support members through the use of one or more top lock plates 22 connected to the top support member, one or more bottom lock plates 24 connected to the HVAC unit 5, and one or more suspension chains 26 connected between the top lock plates 22 and the bottom lock plates 24. The suspension system provides a system for suspending HVAC equipment for residential and light commercial applications that is safer, quicker, cheaper, more reliable and more accurate than systems currently in use.

For example, the suspension system allows most residential and light commercial HVAC equipment to be installed by one person. The suspension system does not require the usage of heavy and relatively expensive angle iron. As described in more detail below, the suspension system can be adjusted at least twice during installation: (1) gross adjustments can be made by adjusting the lengths of suspension chain 26 through the top and bottom lock plates 22, 24 and (2) fine adjustments can be made by rotating the top lock plate 22 about the first fastening point 32 before fixing the second fastening point 34. The suspension system need not leave any sharp edges or sharp corners and edges that could injure the installers, other trades people or the owner. The suspension system permits the secondary pan 12 to be installed in close proximity to the HVAC unit 5 to minimize bumping or bending by other tradesmen and/or the owner. Similarly, the suspension system does not employ any angle iron 14, so no leakage bypasses the secondary pan 12 to drip on surfaces below.

The description of the invention that follows, together with the accompanying drawings, should not be construed as limiting the invention to the example shown and described, because those skilled in the art to which this invention pertains will be able to devise other forms thereof within the ambit of the appended claims.

DESCRIPTION OF PREFERRED EMBODIMENT

Figure 1:
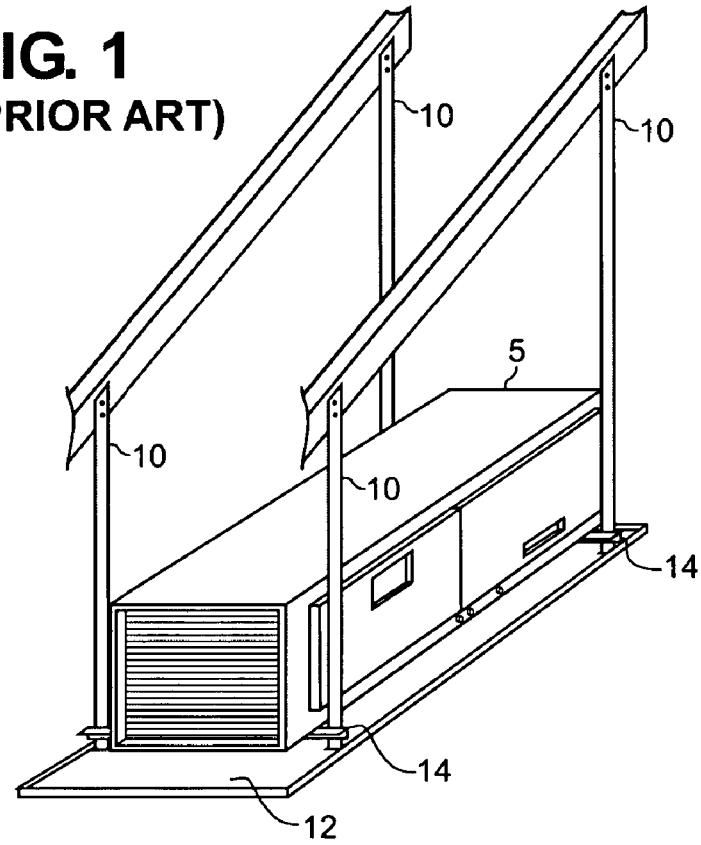
FIG. 1 (PRIOR ART)
FIG. 1 illustrates a widely used prior art system for hanging air handlers.

It is to be understood that the descriptions below are merely illustrative of the presently preferred embodiments of the invention and that no limitations are intended to the detail of construction or design herein shown other than as defined in the appended claims. In this specification, the term "HVAC unit" refers to a gas furnace and/or a heat pump air handler used in residential and light commercial applications or other similar HVAC equipment. Examples of an "HVAC unit" include those units manufactured by the CARRIER® Corporation under model numbers 58STA, 58DLA, 58CTA, 58CVA, 58STX, 58DLX, 58CTX, and 58CVX, those manufactured by GOODMAN® Manufacturing Company, L.P., those manufactured by American Standard, Inc. under the trademark TRANE® and those manufactured by YORK® International Corporation. Other air handlers, furnaces and related HVAC equipment could also be employed by the suspension system described herein. Similarly, while the description that follows is generally directed at installations where a wood truss provides the structural support at the top, the suspension system described herein could be adapted to fit other types of structural top support members.

Generally, the invention is incorporated in a system for suspending an HVAC unit 5 from one or more wood truss members through the use of one or more top lock plates 22 connected to the wood truss, one or more bottom lock plates 24 connected to the HVAC unit 5, and one or more suspension chains 26 connected between the top lock plates 22 and the bottom lock plates 24.

While many materials, dimensions, thicknesses and combinations thereof can be used to construct the top lock plate 22, it is preferred that the top lock plate 22 be made from 16 gauge galvanized steel. See e.g., FIG. 6A. The preferred top lock plate 22 is 6.5625 inches long and 1.5 inches wide. The preferred top lock plate 22 has rounded corners and edges. The preferred top lock plate 22 has a first fastening point 32 located 0.75 inches from the top edge. The preferred top lock plate 22 has a second fastening point 34 located 1.5 inches below the first fastening point 32. It is preferred that the first and second fastening points 32, 34 be a hole approximately 0.188 inch in diameter through the top lock plate 22.

Figure 5A:
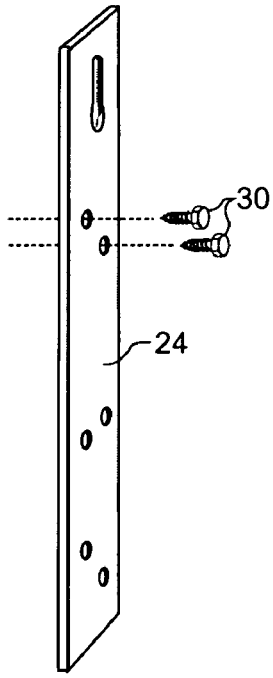
FIG. 5A illustrates a preferred embodiment of a bottom locking plate.
Figure 5:
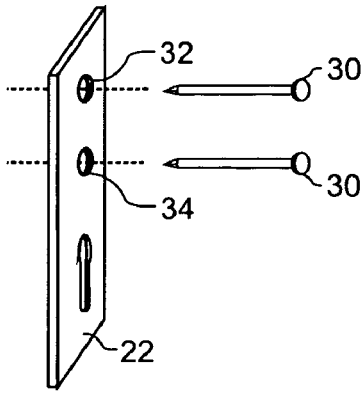
FIG. 5 illustrates a preferred embodiment of a top locking plate.

As shown in FIG. 5, the preferred top lock plate 22 has an opening to permit a suspension chain 26 to slidably pass through. While it is preferred to use a 1-inch 155-pound double loop chain for the suspension chain 26, many types of chains, ropes, or other flexible tensile elements could be used. If the preferred chain is used, it is also preferred that the opening be 0.625 inches in diameter centered 1.8125 above the bottom of the top lock plate 22. As shown in FIG. 5, it is preferred that a locking slot extend downward from the edge of the opening. The slot should be wide enough so that one link of chain can slide sideways into the slot, but not so wide to permit the suspension chain 26 to pass through the slot altogether. If the preferred suspension chain 26 is used, it is preferred that the slot be 0.141 inches wide and 1.3125 inches long. If the preferred top lock plate 22 is used, it is also preferred to use at least one lock plate for every 55 pounds of HVAC unit 5 being suspended. If the preferred suspension chain 26 is used, it is also preferred to use at least one suspension chain 26 for every 55 pounds of HVAC unit 5 being suspended.

Figure 6:
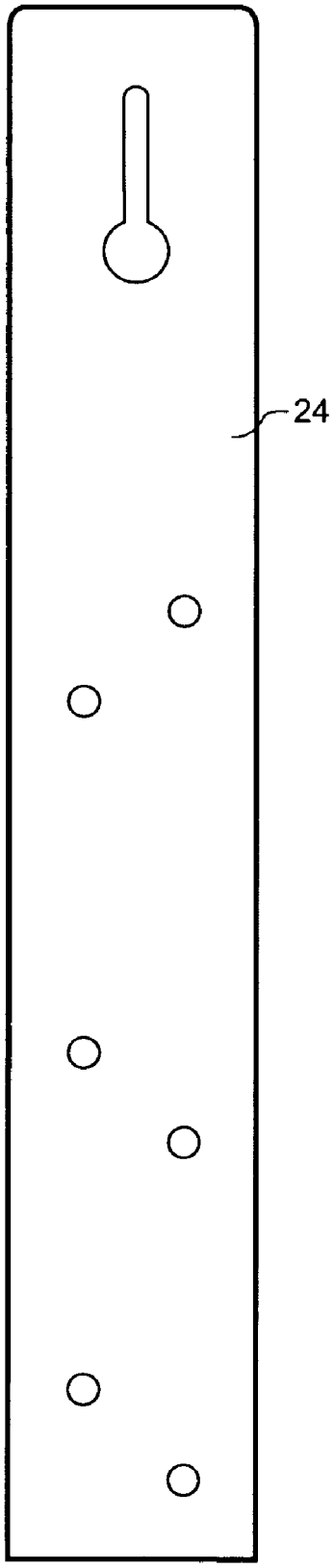
FIG. 6 illustrates a view of a preferred embodiment of a bottom locking plate.
Figure 6A:
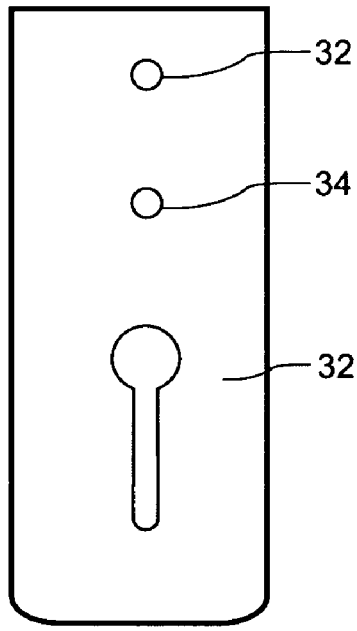
FIG. 6A illustrates a view of a preferred embodiment of a top locking plate.
Figure 7:
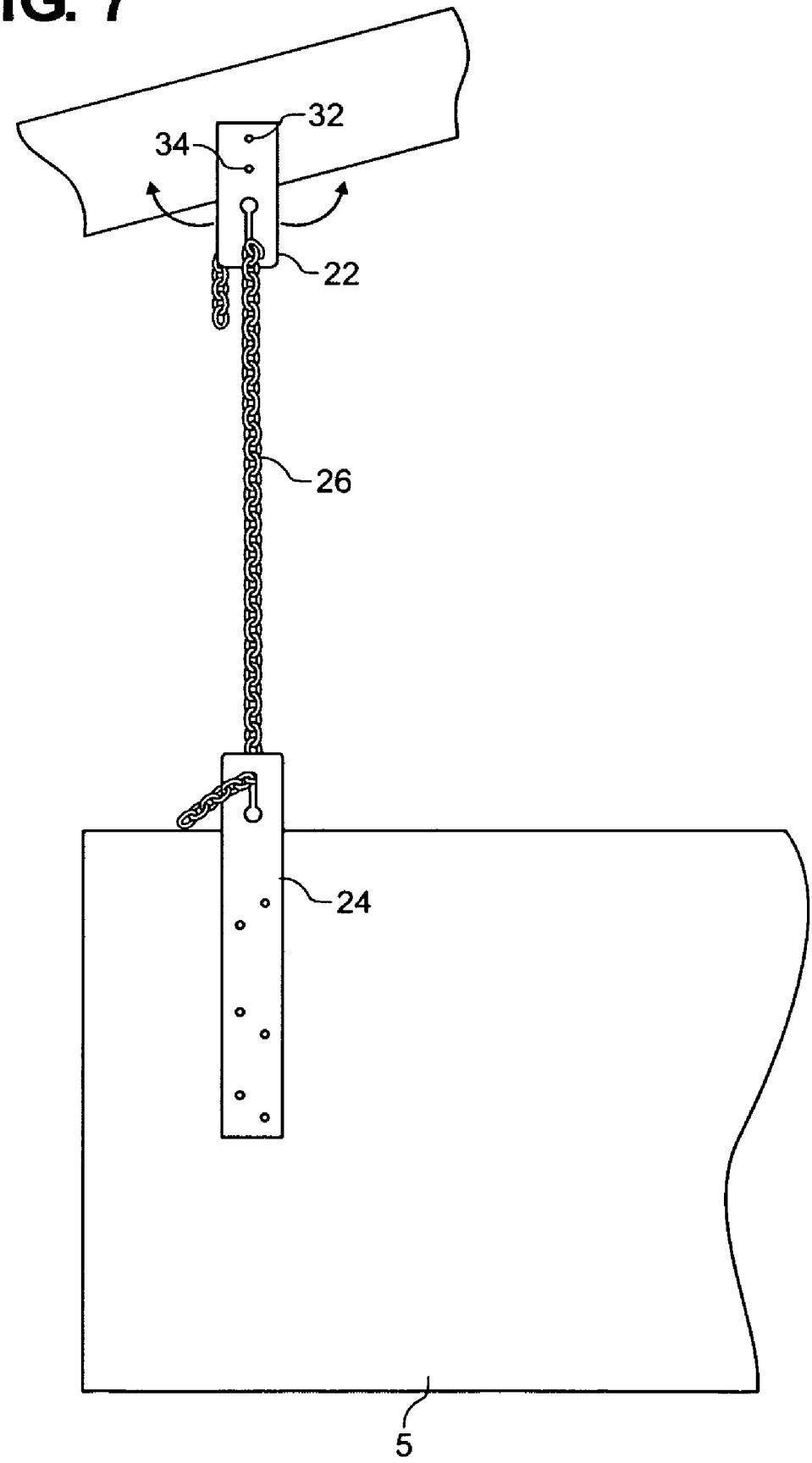
FIG. 7 illustrates a side view of one connection and illustrates the adjustability of rotating the top lock plate 22 about the first connection point.

Like the top lock plate 22, many materials, dimensions, thicknesses and combinations thereof can be used to construct the bottom lock plate 24. It is preferred that the bottom lock plate 24 be made from 16 gauge galvanized steel. The preferred bottom lock plate 24 is 16 inches long and 1.5 inches wide. The preferred bottom lock plate 24 has rounded corners and edges. The preferred bottom lock plate 24 has a plurality of fastening points as shown in FIGS. 5A & 6. The preferred bottom lock plate 24 has six fastening points wherein each fastening point is a hole approximately 0.188 inch in diameter through the bottom lock plate 24.

As shown in FIG. 5, the preferred bottom lock plate 24 has an opening to permit a suspension chain 26 to slidably pass through. While it is preferred to use a 1-inch 155-pound double loop chain for the suspension chain 26, many types of chains, ropes, or other flexible tensile elements could be used. If the preferred suspension chain is used, it is also preferred that the opening be 0.625 inches in diameter centered 1.8125 below the top of the bottom lock plate 24. As shown in FIG. 5A, it is preferred that a locking slot extends upward from the edge of the opening. The slot should be wide enough so that one link of chain can slide sideways into the slot, but not so wide to permit the suspension chain 26 to pass through the slot altogether. If the preferred suspension chain 26 is used, it is preferred that the slot be 0.141 inches wide and 1.3125 inches long. If the preferred bottom lock plate 24 is used, it is also preferred to use at least one bottom lock plate 24 for every 55 pounds of HVAC unit 5 being suspended.

Figure 2:
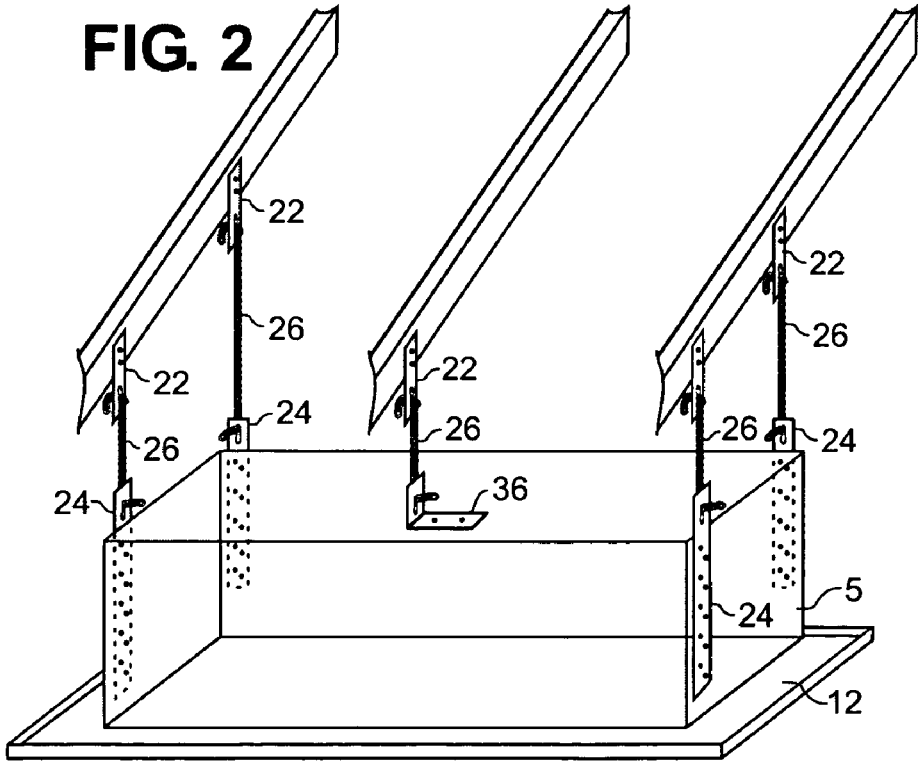
FIG. 2 illustrates the suspension system in a five-connection point embodiment.
Figure 2A:
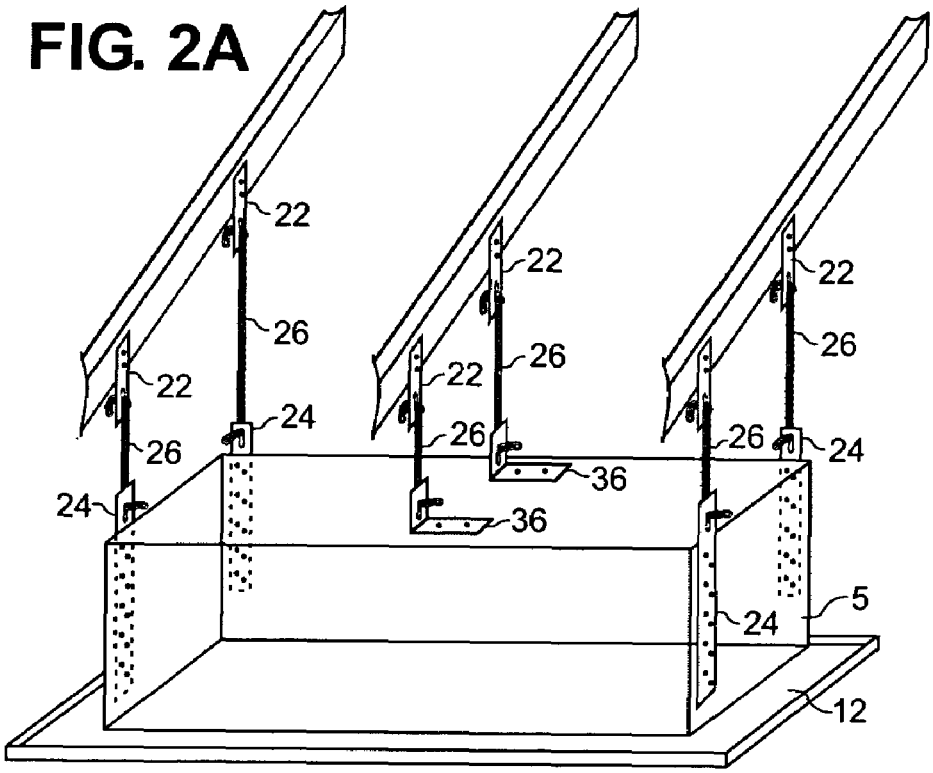
FIG. 2A illustrates the suspension system in a six-connection point embodiment.
Figure 5B:
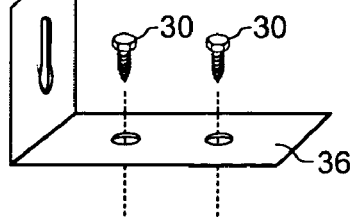
FIG. 5B illustrates an alternative embodiment for a bottom locking plate for horizontal mounting connections.

An alternative embodiment of a bottom lock plate 24 is a right-angle bottom lock plate 36 is shown in FIG. 5B. As shown in FIGS. 2 & 2A, the right-angle bottom lock plate 36 can be used for additional support by connecting it to a horizontal surface on the HVAC unit 5. It is preferred to right-angle bottom lock plate 36 be constructed by bending a preferred top lock plate 22 between the second fastening point 32 and the locking slot. However, many other methods, materials and dimensions can be suitable.

It is preferred to connect each bottom lock plate 24 directly to the cabinet of the HVAC unit 5. Many types of fasteners 30 can be used. It is preferred to use #8 hex screws. It is recommend that prior to connecting the bottom lock plate 24 to the cabinet of the HVAC unit 5, the installer should verify that the fastener 30 will not interfere with the interior wiring or other internal HVAC parts upon during the connection process.

While many fasteners 30 can be used to connect the top locking plate to the wood truss, it is preferred to connect the top lock plate 22 to the wood truss using 16d nails. During installation, it is preferred that only the first fastening point 32 be connected to the truss at the beginning. Once the HVAC unit 5 has been hung and the suspension chains 26 adjusted, the top lock plate 22 can be rotated about the first fastening point 32 to make finer adjustments to the level height of the HVAC unit 5 before the second fastening point 34 is connected to the wood truss.

Once the HVAC unit 5 has been suspended, a secondary pan 12 can be fastened directly to the cabinet of the HVAC unit 5. It is preferred to fasten the secondary pan 12 using # 8 hex screws. The secondary pan 12 should be adjusted to create a slight tilt towards the corner having the drain 38. The secondary pan 12 is preferably installed less than one inch below the bottom of the HVAC unit 5.

Figure 8:
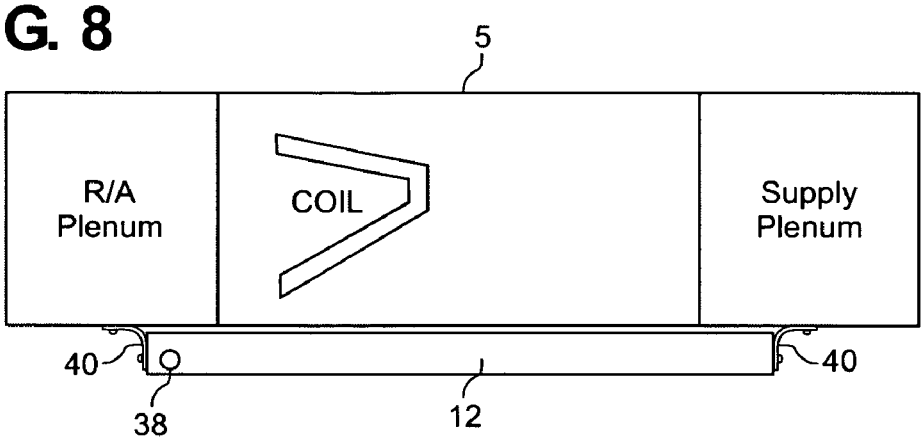
FIG. 8 illustrates the preferred embodiment for a heat pump auxiliary pan installation method and location.
Figure 8A:
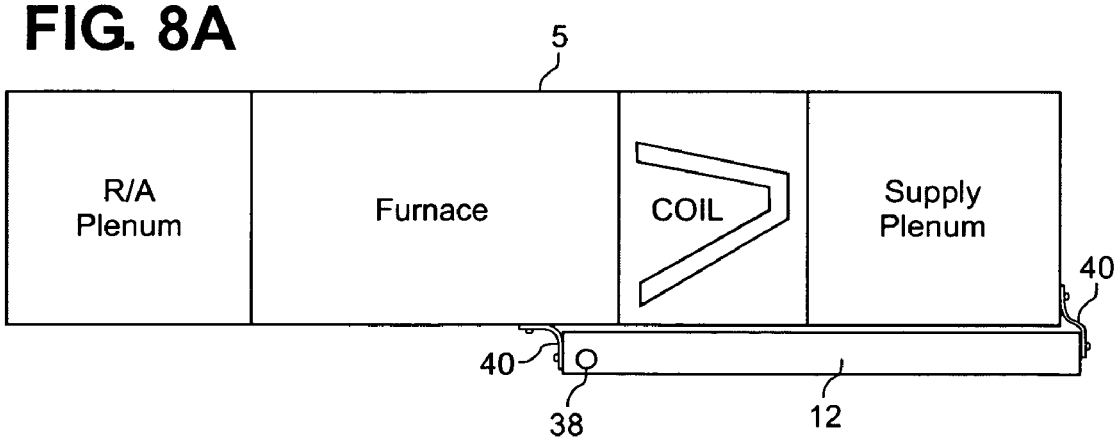
FIG. 8A illustrates the preferred embodiment for a furnace (with cooling coils) auxiliary pan installation method and location.

As shown in FIG. 8, it is preferred to strap 40 the secondary pan 12 in a location so that the secondary pan 12 covers the area underneath the entire coil for the heat pump. As shown in FIG. 8A, it is preferred to strap 40 the secondary pan 12 in a location so that the secondary pan 12 covers the area underneath the entire coil and supply plenum for the furnace. Most any straps 40 can be used, but it is preferred to use sheet metal straps with Y½-inch long, #8 sheet metal screws in the locations shown. Other fastening methods, including those approved by Byan, can also be employed.

Figure 3:
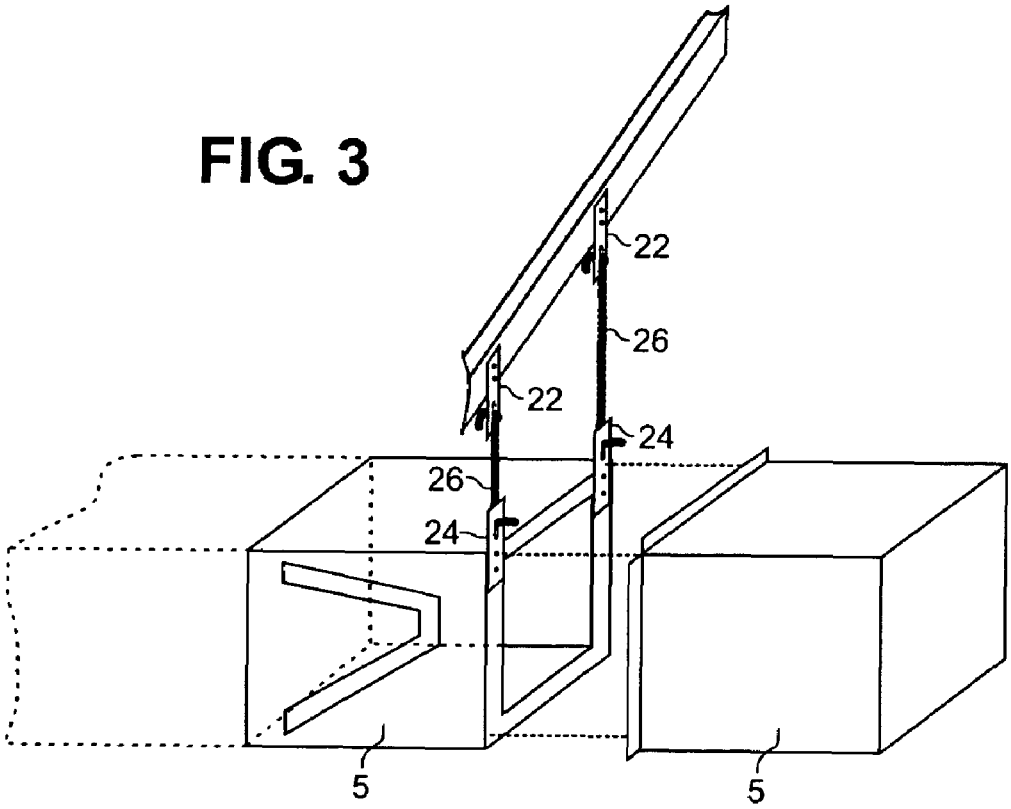
FIG. 3 illustrates the suspension system in a two-connection point embodiment.
Figure 4:
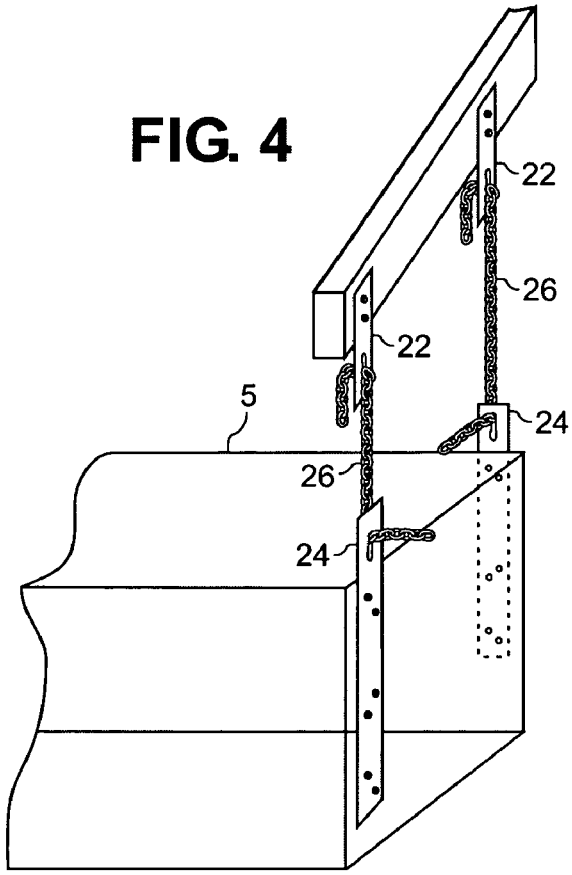
FIG. 4 illustrates the suspension system in a two-connection point embodiment.

In practice, an installer using the preferred embodiments of the suspension system described herein could employ the following steps to install an HVAC unit 5 in a residential or light commercial application having wood trusses for support:

1. Set HVAC unit 5 on the bottom chord of the trusses at the location where the HVAC unit 5 is intended to be suspended;
2. Connect bottom lock plates 24 to HVAC unit 5 using as shown in FIGS. 2-4, using at least 4—#8 hex screws per strap, and verifying that no screw will interfere with hit coil, wiring or other HVAC unit 5 parts as it penetrates cabinet wall;
3. Connect the top lock plate 22 to the top chord of truss by driving one 16d nail through the first fastening point 32, making sure top lock plates 22 are plumb with the straps on the equipment and in-line with each other;
4. Cut the suspension chain 26 to length by applying the following formula:

Length of suspension chain=$A-B$ plus 10 inches, where

A=the distance from the locking slot in the top lock plate 22 to the locking slot on the bottom lock plate 24 when the HVAC unit 5 sitting on the bottom chord of the truss with the bottom locking plates directly below the top locking plates.

B=the distance that the HVAC unit 5 will be suspended above the bottom chord of truss (preferably at 24" above truss if space allows).
5. Slip each suspension chain 26 through the opening of each top lock plate 22, leaving three extra links of suspension chain 26 on one side of the top lock plate 22;
6. Lift one end of the HVAC unit 5 and slip the suspension chain 26 through the opening in each bottom lock plate 24, leaving three extra links of suspension chain 26;
7. Adjust links through locking slots in either the top or bottom lock plates to make HVAC unit 5 as close to level as possible;
8. Pivot top lock plates 22 about the first fastening point 32 to make final level adjustments to the HVAC unit 5, and drive a second 16d nail through the second fastening point 34 once final adjustments have put the HVAC unit 5 in its most desired position;
9. Cut off any suspension chain 26 in excess of three extra links;
10. Connect secondary pan 12 to HVAC unit 5 with #8 hex screw, ensuring that secondary pan 12 is tilted towards the drain corner.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A system for suspending an HVAC unit from a top support member comprising:

an HVAC unit, a suspension chain, a bottom lock plate, wherein the bottom lock plate is connected to the HVAC unit, wherein the bottom lock plate has a bottom hole that permits a suspension chain to freely pass through the bottom hole and where the bottom hole has an adjacent bottom slot to lock the suspension chain, a top lock plate, wherein the top lock plate is connected to the top support member, wherein the top lock plate has a top hole that allows a suspension chain to freely pass through the top hole and where the top hole has an adjacent top slot to lock the adjustable chain, and, wherein the HVAC unit is suspended from the top support member by sliding the suspension chain though the top hole and locking it in the top slot and by sliding the suspension chain through the bottom hole and locking it in the bottom slot.

2. The suspension system of claim 1, the top lock plate further comprising a first connection point and a second connection point, wherein the first connection point can support the design load by itself to permit height adjustment of the HVAC unit by fastening the top lock plate to the top support member at the first connection point and rotating the top lock plate about the first connection point as needed before fastening the top lock plate to the top support member at the second connection point.

* * * * *